US008789487B2

(12) United States Patent
Lizzio

(10) Patent No.: US 8,789,487 B2
(45) Date of Patent: Jul. 29, 2014

(54) PERSONAL WATERCRAFT

(76) Inventor: Jeffrey D. Lizzio, Berlin, NJ (US)

( * ) Notice: Subject to any disclaimer, the term of this patent is extended or adjusted under 35 U.S.C. 154(b) by 0 days.

(21) Appl. No.: 13/555,071

(22) Filed: Jul. 20, 2012

(65) Prior Publication Data

US 2014/0020612 A1 Jan. 23, 2014

(51) Int. Cl.

| | |
|---|---|
| ***B63B 3/00*** | (2006.01) |
| ***B63B 35/73*** | (2006.01) |
| ***B63B 17/00*** | (2006.01) |
| ***B63B 29/06*** | (2006.01) |
| *B63B 1/04* | (2006.01) |
| *B63B 35/58* | (2006.01) |
| *B63H 20/00* | (2006.01) |
| *B63B 29/04* | (2006.01) |

(52) U.S. Cl.

CPC ..... *B63B 35/731* (2013.01); *B63B 1/041* (2013.01); *B63B 35/58* (2013.01); *B63H 20/007* (2013.01); *B63B 2029/043* (2013.01); *B63B 35/73* (2013.01); *B63B 17/00* (2013.01); *B63B 29/06* (2013.01)

USPC ..... 114/346; 441/131

(58) Field of Classification Search

USPC ..... 114/346; 441/131

See application file for complete search history.

(56) References Cited

U.S. PATENT DOCUMENTS

| | | | | |
|---|---|---|---|---|
| 4,021,873 | A * | 5/1977 | Francois | 114/345 |
| 4,367,689 | A * | 1/1983 | Lukehart et al. | 114/346 |
| 5,081,947 | A * | 1/1992 | Holden | 114/345 |
| 5,331,914 | A * | 7/1994 | Salmons | 114/346 |
| 6,375,522 | B1 * | 4/2002 | Bellens et al. | 440/40 |
| 6,543,378 | B1 * | 4/2003 | Johnson, Sr. | 114/346 |
| 6,962,124 | B1 * | 11/2005 | North et al. | 114/346 |
| 8,047,886 | B1 * | 11/2011 | McLarty et al. | 441/66 |
| 8,056,494 | B1 * | 11/2011 | Shalley | 114/346 |

* cited by examiner

*Primary Examiner* — Lars A Olson
*Assistant Examiner* — Jovon Hayes
(74) *Attorney, Agent, or Firm* — Donald C. Simpson, Esq.

(57) ABSTRACT

A personal watercraft comprising: a) a generally vertical outer hull; b) a bottom member affixed to the lower edge of said outer hull and closing the watercraft from the encroachment of surrounding water into the vessel; c) a generally concave inner hull rigidly attached at its upper edge to the upper edge of said outer hull and extending downwardly toward said bottom; and d) a generally horizontal deck fixedly attached at its edges to the lower edge of said inner hull to form an enclosed space with said outer hull, inner hull, and bottom member; said deck having a size sufficient for the support of at least one person in a standing or reclining position and of sufficient cient strength and support to avoid undue bending from the weight of the user.

9 Claims, 22 Drawing Sheets

PERSONAL WATERCRAFT

FIELD OF THE INVENTION

The present invention relates to a personal watercraft having an inner and outer hull and characterized by a deck that, when occupied by a standing or sitting user, gives the vessel a center of gravity substantially lower than in the watercraft of the relevant prior art.

BACKGROUND OF THE INVENTION

There are numerous watercraft described in the prior patent art. Examples include U.S. Pat. No. 6,543,378 to Johnson, U.S. Pat. No. 4,021,873 Francois, U.S. Pat. No. 5,331,914 to Salmons, and U.S. Pat. No. 6,962,124. While the various patentees stress stability of their particular watercraft, they are essentially glorified rafts with decks located vertically well above the center of gravity of the vessel. Since these circular watercraft are designed for fishing, standing to cast would be a common but risky event. A person standing on the deck of such vessels would be in danger of falling overboard. This would be particularly true in the vessel described by Salmons in which, additionally, the deck is free to rotate independently of the hull.

BRIEF SUMMARY OF THE INVENTION

Much like the watercraft of the prior art, the vessel of the present invention comprises a generally vertical hull and a bottom. It differs from the prior art watercraft in that it has no top side, but instead has a concave inner hull and a round deck fixedly attached to the inner hull well below the top edge of the vessel. The outer hull and inner hull are rigidly attached to each other at that top edge. The bottom of the vessel of the present invention may be flat, but it is preferably provided with a modified prow and/or a modified keel. The vessel of the present invention is also preferably provided with a unique, detachable, pedestal mount for a seat position generally centrally of the aforementioned round deck.

DETAILED DESCRIPTION OF THE INVENTION

The essential elements of the boat are the outer hull (1), the bottom (2), the inner hull (3), and the deck (4).

Figure 6:
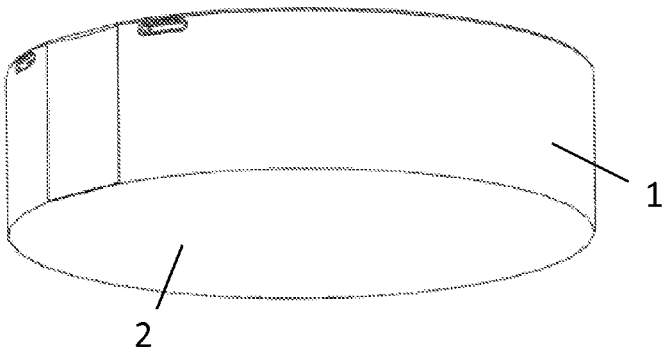
FIGS. 6 through 10 illustrate different bottom configurations that can be used with the vessel of the present invention.
Figure 7:
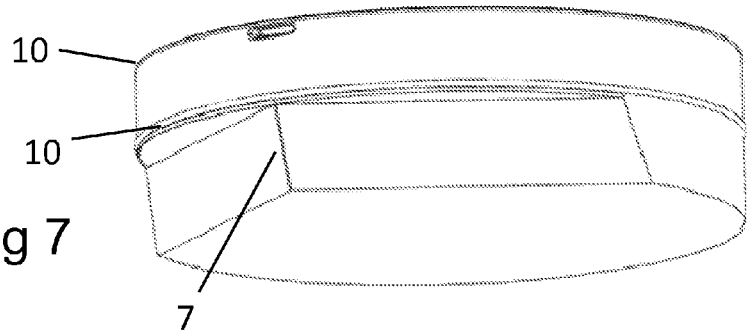
Figure 8:
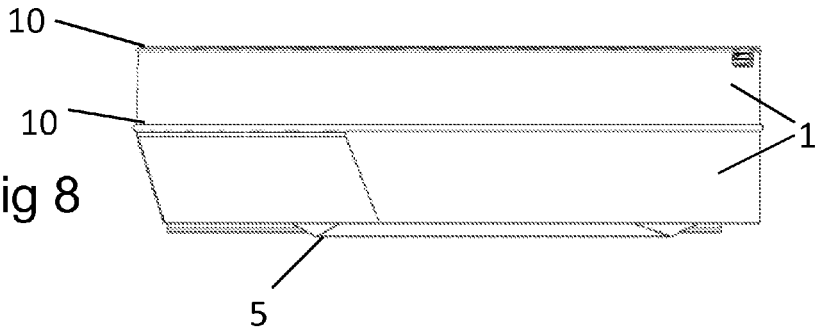
Figure 9:
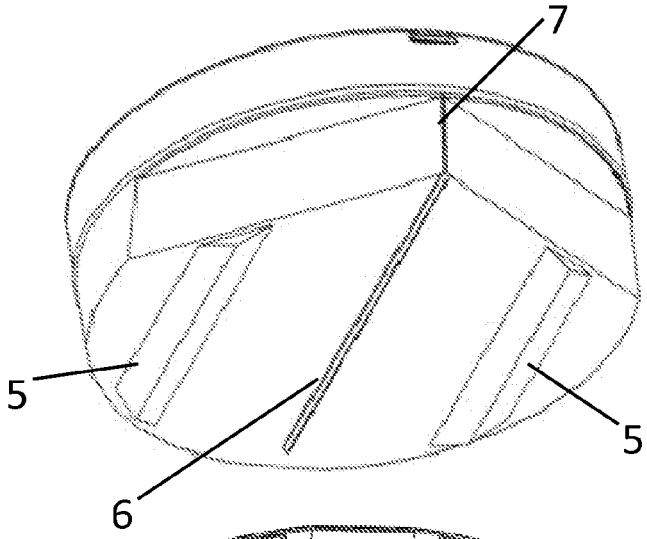
Figure 10:
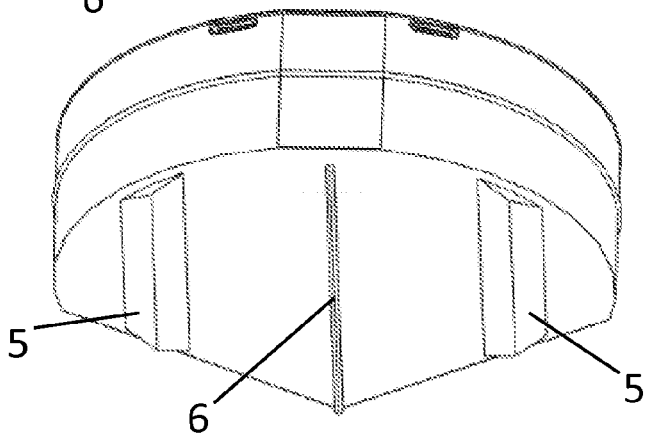
Figure 11:
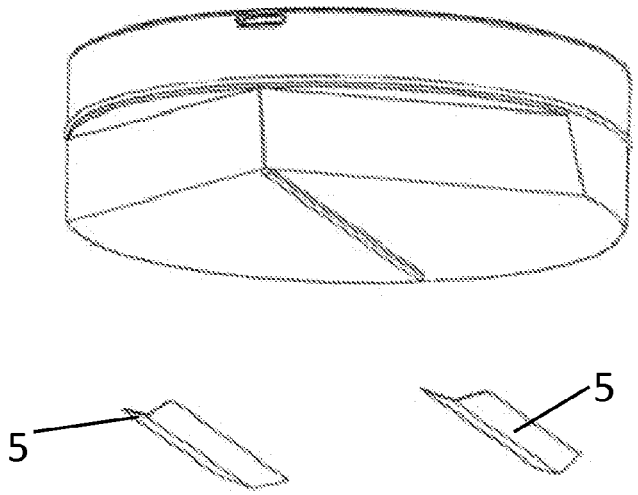
FIG. 11 shows a pair of open pontoon guides which may be provided on the underside of the shown boat for improving tracking and stability.
Figure 12:
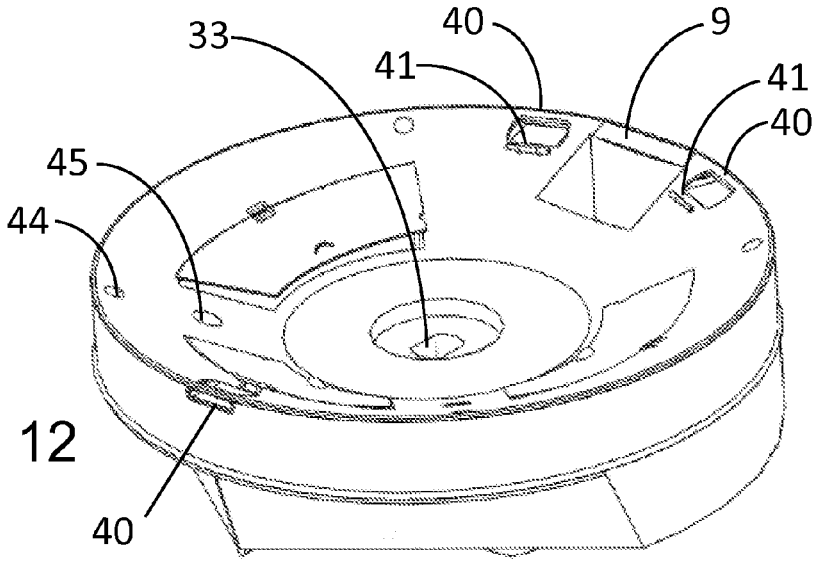
FIGS. 12 through 15 show different views of the interior of the preferred embodiment of the invention, with the pedestal mount and seat detached.
Figure 13:
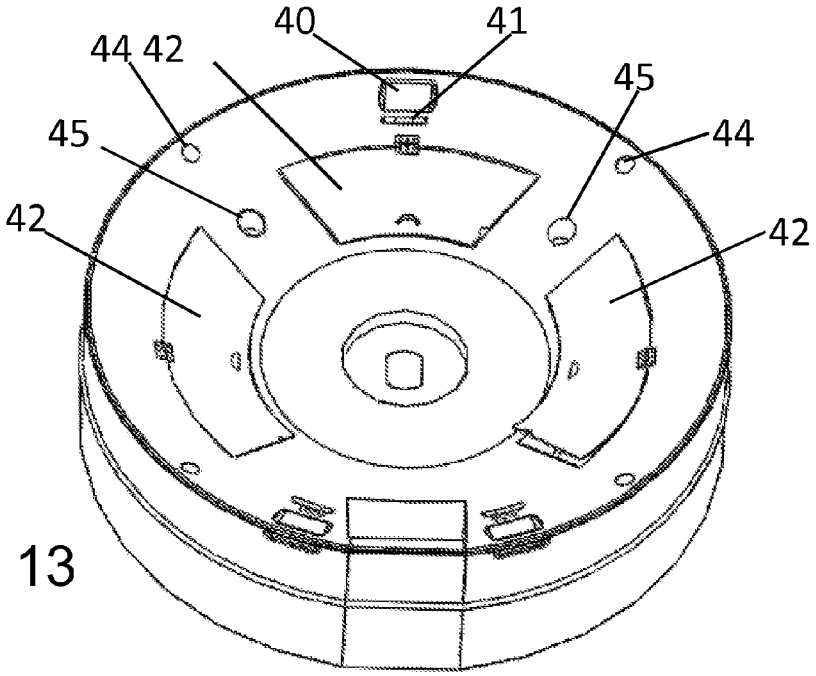
Figure 14:
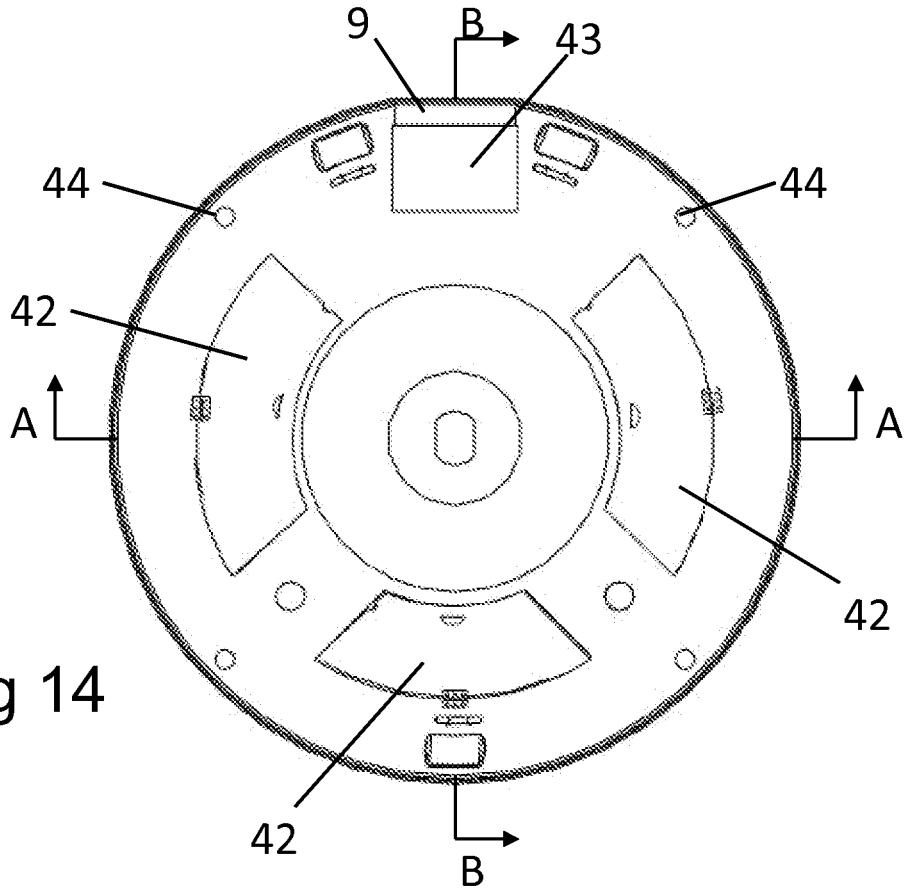
Figure 15:
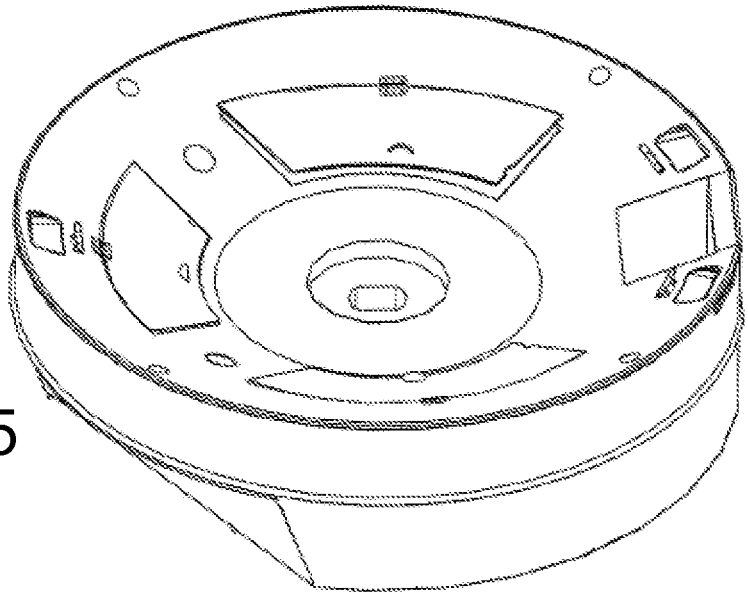
Figure 16:
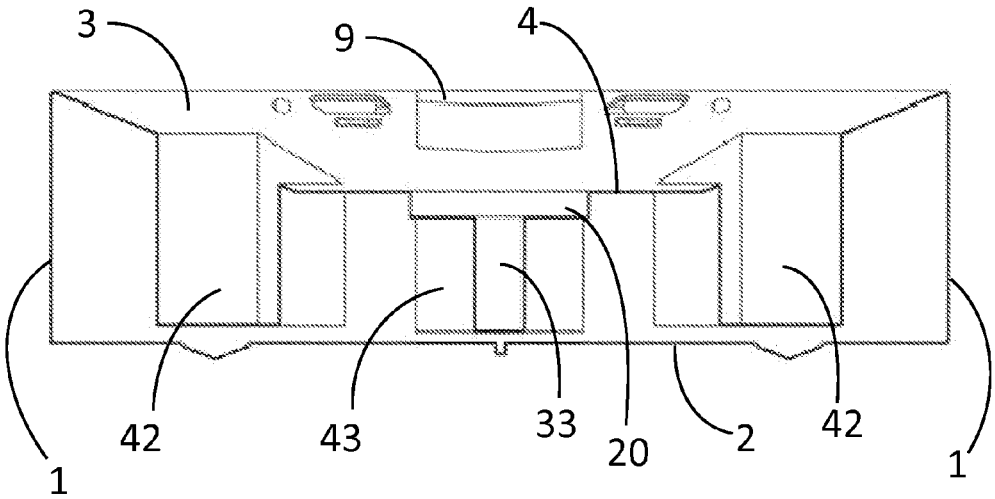
FIGS. 16 and 17 are cross-sectional views taken through lines A-A and B-B, respectively, of FIG. 14.
Figure 17:
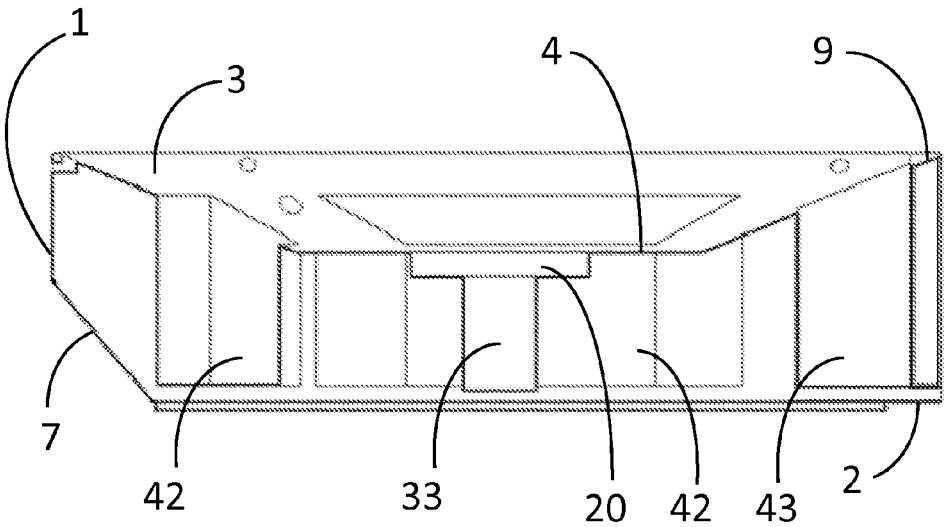

The bottom (2), as shown in FIG. 6), may be completely flat. The preferred embodiment for the bottom, as shown in FIGS. 8 through 10 include two small pontoon-like guides (5). FIGS. 9 through 11-show embodiments with a central keel (6). There are other embodiments that could be used that would alter the balance, speed and draft of the watercraft. These designs are commonly referred to but not limited to V-bottom, Round Bottom, Tri Hull (Cathedral), Catamaran, Tunnel Bottom(Hydroplane), and Multi Hull (attached Pontoons).

A flat bottom provides added stability when the user is leaning over the side of the boat or unintentionally transfers weight toward the edge of the boat. A displacement hull such as a V bottom design is faster while moving, but there is a loss of some stability. During operation of the boat, the pontoon guides (5) add buoyancy, stability, and a "tunnel" effect, while also acting as additional keels. Increasing the size of the pontoons will cause a corresponding increase in the tunnel effect and correspondingly increase the stability of the vessel. While in or out of the water, the pontoon guides (5) are important adjuncts to protect the bottom from scratches when contacting a hard surface.

As shown in FIGS. 1 through 4, the boat bottom and its joinder with the outer hull can be modified to form a prow (7) to displace water while in motion and thereby keep the boat from nose-diving. The less sharp the angle of the prow, the less buoyancy is experienced toward the front of the boat during its movement through the water. It is also possible to angle the side junctures of the bottom with the outer hull to deflect spray at speed, but this will also sacrifice some stability.

The back of the boat (the stern) can also have an angled bottom shape applied to it that is similar to the front. This could be designed as a "wedge" instead of a pointed shape because the boat will primarily be moving forward instead of in reverse. This may not do much to increase the speed or performance of the watercraft but would help keep an equal draft on the bow and stern if using a light weight electric outboard motor.

A transom (9) for an electric motor (8) can be designed in any way that allows a motor with a mounting bracket to be attached to the vessel. In addition to the transom shown in the drawings, it could be a flat surface with a bracket that would allow a "bow mount" type trolling motor, which can be used with an external foot control switch that would enable hands-free operation of the vessel. A transom can be added to the bow of the watercraft, or even can be recessed in closer to the center of the boat.

The current design of the watercraft of the present invention works well with a variety of motor-battery combinations. For example, it has been used with a motor-battery combination in the stern position (typically, 70-120 pounds). Today, some electric outboard motors weigh on the order of 35 pounds or less, and most do not require bulky marine batteries. As equipment becomes lighter and less expensive, it may be useful to use the angled stern that provides an amount of buoyancy similar to that found with the angled prow, so as to ensure an equal draft in the prow and stern of the boat when a person is sitting or standing in the center of the watercraft Since the round exterior of the boat permits it to be rolled to the water from a car carrier or trailer, it has been found advisable to provide circumferential roll bars (10), as shown in FIGS. 2 through 5, 7, and 8. A roll bar is basically a long strip of plastic or rubber that can be molded onto or otherwise attached to the outer hull. The purpose of the roll bar is primarily to protect the sides of the outer hull when rolling the boat on a hard surface (e.g., a car parking area or other ground surface) or to act as a bumper when the boat is in close proximity to other boats or structures. There can be more than one circumferential roll bar located on the water craft, and two roll bars are generally preferred, with one along the top edge and a second one midway down the outer hull. For boats having a defined prow, a detachable roll bar designed to fit around the prow can be advantageous.

There are a number of ways to manufacture the boat of the present invention. Thermo-forming is one. Strip built, also called "cedar strip", "wood strip", or "wood-strip epoxy" is another. This method uses thin strips of lightweight wood, edge glued together and covered with fiberglass and epoxy to make the boat. It gives the builder a lot of freedom in the shape of the boat the choose to make. Artistic patterns can be incorporated into the strips using different kinds of wood.

Still another is called "stitch & glue" or "tack and tape", in which flat panels of plywood are cut out to specific shapes, then "stitched" together using wires, tape or cable ties. The panels are then permanently glued together using epoxy and fiberglass. This technique is particularly good for "hard-chined" or "multi-chined" designs "Skin on frame", occasionally called "wood and canvas" is a traditional method used by Aleuts and Inuits. Today the frame is often made of aluminum and the "skin" is canvas or nylon. Some builders cut frames out of plywood. And some cover the frame with plywood.

Welding techniques can be used, when desired, to form the basic hull-bottom structure from sheet metal or sheet plastic.

"Fiberglass", alternately called "composite" is generally limited to commercially manufactured boats. To make a boat this way, fiberglass is laid into a mold and then wet out with resin. This is also the same technique used to build Kevlar and carbon fiber kayaks.

"Roto molded", a common means for making kayaks, is the preferred method for the purposes of the present invention. Typically, a two-story tall machine lifts and spins a large aluminum mold as it is heated up to several hundred degrees. The hot mold is injected with 60 pounds of colored polyethylene plastic beads. As the mold is spun, the beads start to melt and stick to the inside. The machine is capable of making several kayaks an hour. An internet search for kayak rotational molding will turn up excellent videos demonstrating this technique.

Among the things that separate this boat from other round boats is the interaction of the concave inner hull (2) and the encompassed deck (4). The concave inner hull is not a walking area. The deck is a flat area that is connected to the inner hull such that, when occupied by a seated or standing user, gives the vessel a center of gravity substantally lower than in the prior art round watercraft. The combination accomplishes a number of things not found in U.S. Pat. Nos. 6,962,124 and 5,331,914:

1. The concave inner hull deters the user from standing outside the diameter (e.g.,3 ft) of the deck. If the user does attempt to walk or stand on the surface of the inner hull, the user's weight and balance are directed towards the center of the craft. This prevents or deters users from having too much weight close enough to the edge of the boat such that the boat would capsize or take on water.

2. The inner hull causes a significant portion of the flotation/buoyancy of the boat to be confined to the space between the outer hull and the surrounded inner hull beyond the deck perimeter. This is where it is needed the most to prevent the capsizing of a hull of this shape and size.

3. The inner hull creates a comfortable surface that the user can lean on with their arms or rest on with the side of their bodies when kneeling or laying horizontally on the deck and reaching into the water.

4. The inner hull (3) allows the outer hull (1) to be wide enough so that a portion of it can be married to the bottom (2) to be formed, for example, like the prow (7), and the other portion can be flat to define a cylidrical structure that the user can use to roll the boat on its side.

5. The inner hull allows deeper storage compartments on the boat. Since the inner hull is higher than the deck, there can be storage compartments that go from the bottom of the inner hull to the top of the inner hull, giving more space inside for storage.

The pedestal mount is something that allows the attachment of a pedestal (pole and base) to a deck. A detachable pedestal mount as shown in the drawings allows the pedestal to be removed from the deck without having to remove the pedestal base from whatever bracket it is attached to. The design of this pedestal mount is made to be compatible with many different designs of seat pedestal systems. Some seat pedestal systems allow the pole to be detached from the base, which gives the user of the craft room to stand up, as well as gives the user of the craft a lighter detachable pedestal mount to carry when dismantling the pedestal from the deck and carrying it to another destination.

Without a detachable pedestal mount, a pedestal mount can be molded into the deck allowing the attachment of a pedestal. Instead of attaching a base to the deck, a pedestal pole could be attached into or detached from a hole or slot in the deck that is designed to fit the particular size and shape of the pedestal pole. Such pedestal pole could be a straight pole, or it could have a base plate (similar to the platform of the detachable pedestal mount) permanently attached to it as one unit. This would eliminate the need for a detachable pedestal mount but would mean an added expense for the manufacturer, and a loss of convenience for the user.

Figure 1:
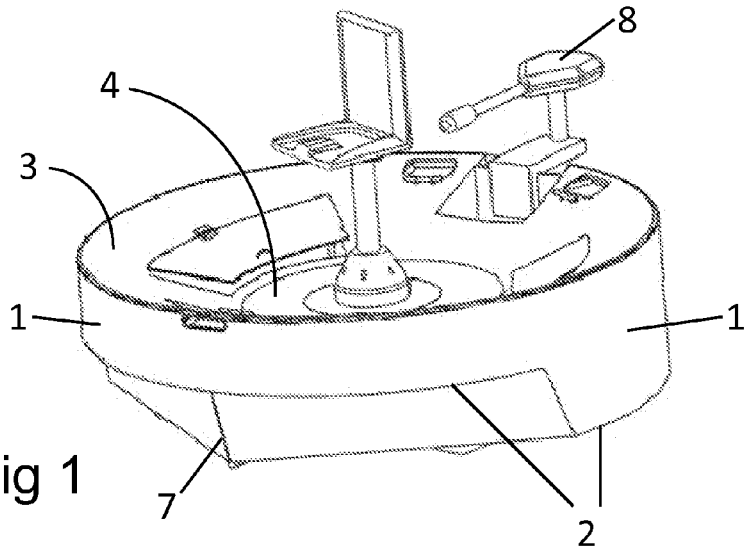
FIG. 1 illustrates a view of a preferred embodiment of the invention (without rollbars) in which the bottom of the vessel is provided with a modified prow and in which the vessel has a detachable pedestal mount and seat.
Figure 2:
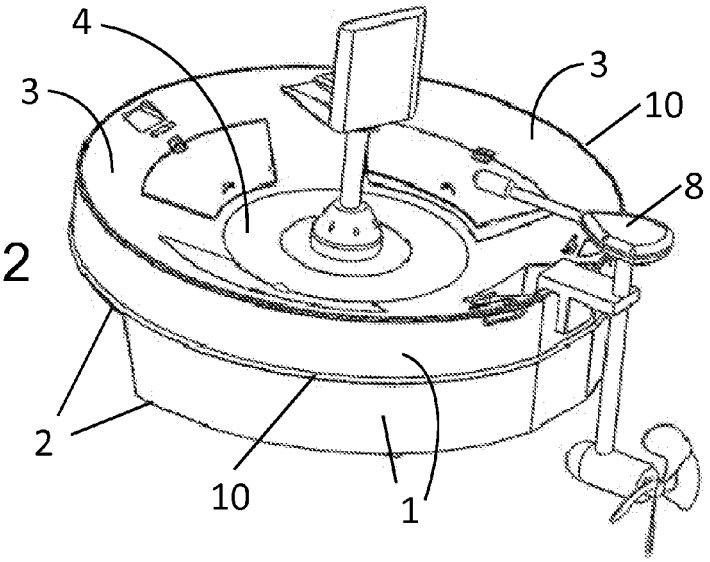
FIGS. 2 through 4 illustrate views of a more preferred embodiment of the invention of FIG. 1, but with rollbars.
Figure 3:
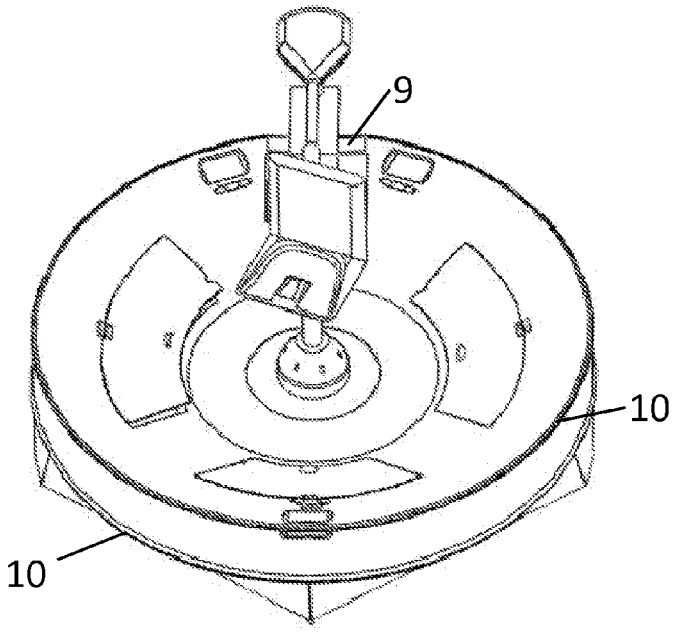
Figure 4:
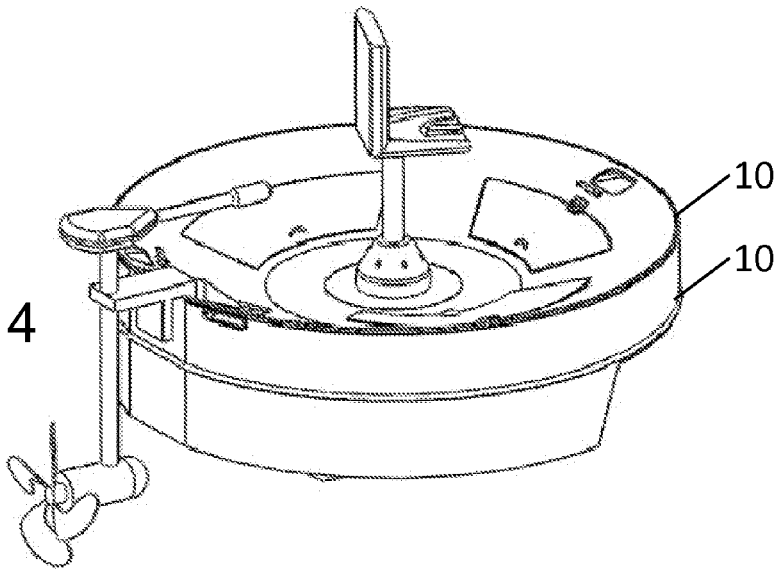
Figure 5:
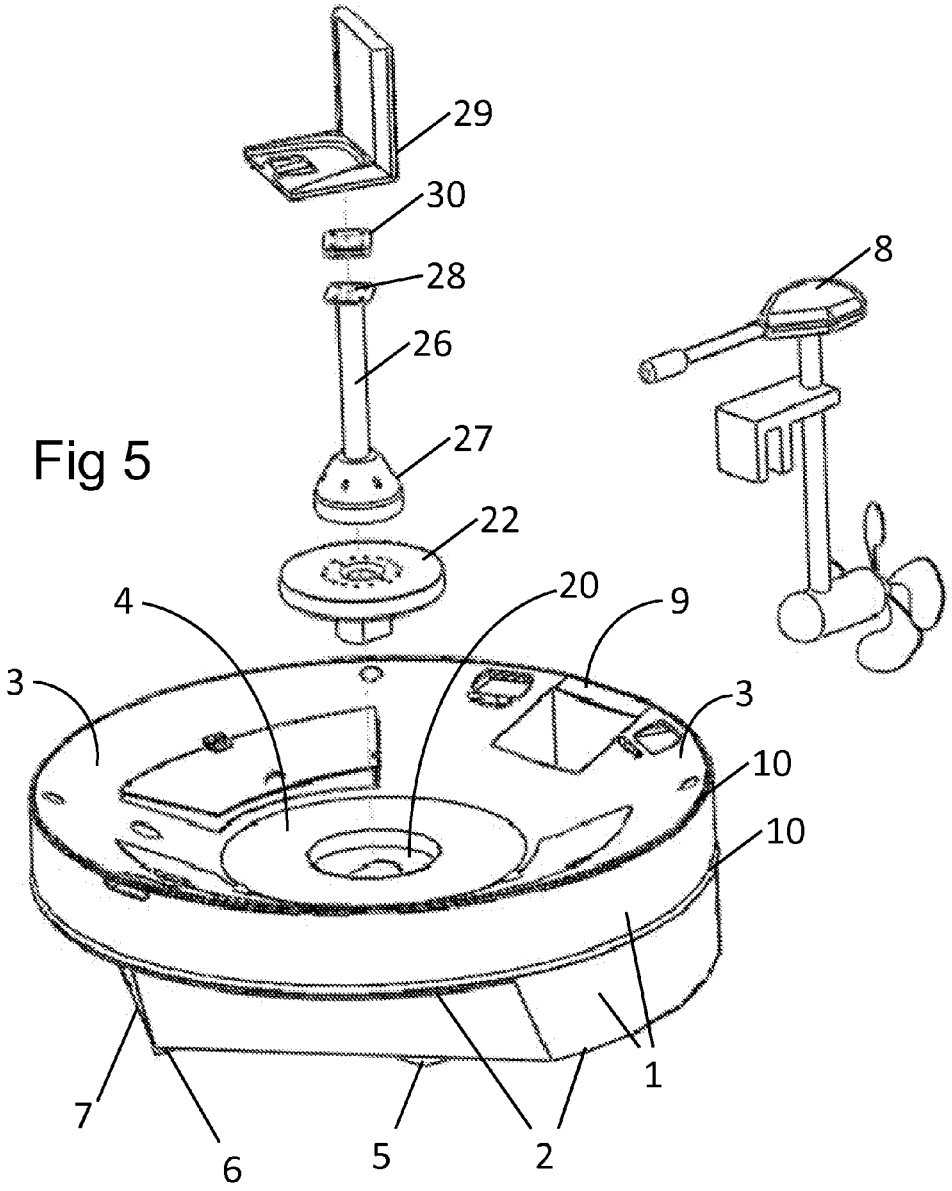
FIG. 5 is an exploded diagram of the embodiment of FIGS. 2-4.
Figure 18:
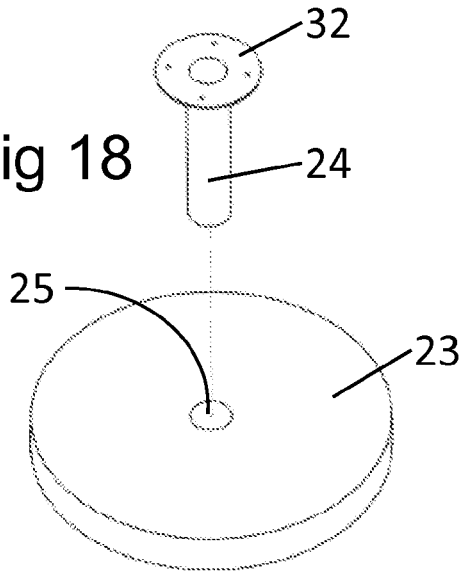
FIG. 18 is an exploded view of an example of a detachable pedestal mount platform.
Figure 19:
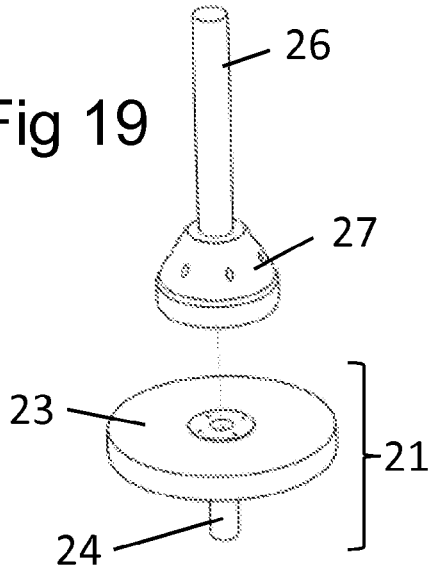
FIG. 19 is an exploded view of one version of the pedestal mount platform with a partial pedestal seat post.
Figure 20:
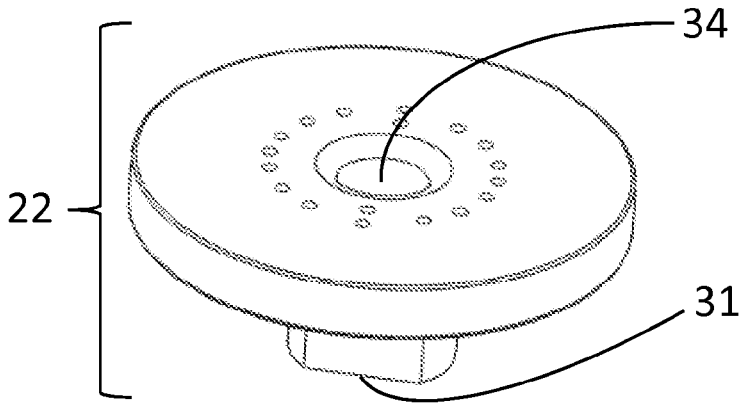
FIGS. 20 and 21 are different views of the preferred pedestal mount which can be manufactured as a single unit.
Figure 21:
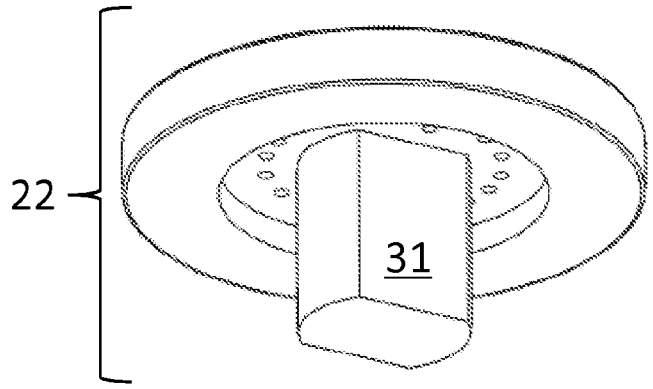

A unique, detachable pedestal mount for the purposes of the present invention is shown in detail in FIGS. 5 and 18, through 21. The deck (4) is provided with a central "well" (20) adapted to receive a flush pedestal mount (21) or (22). As is shown in the exploded view of FIG. 19), pedestal mount (21) comprises a pedestal platform (23) and a pedestal mount "pole" (24) adapted to seat in the hole (25) in the center of the platform and to be afixed to the platform by fitting (26). The exact sizes and shapes of these various parts are not critical provided they serve the described purposes. The bottom of the central well (20) is provided with a slot of size and shape to receive the extended portion of the mast pole when the mast pole mount (21) is seated in the central well (20). As shown in FIG. 20, a pedestal pole (26) having an appropriate terminal fitting (27) can be attached directly to the pedestal platform. As can be seen in FIG. 18, the opposite end of the pedestal pole (26) is provided with a fitting (28) suitable for attachment to a seat (chair) (29) directly, or through a fitting (30) that will permit rotation of the seat relative to the pedestal platform.

Figure 22:
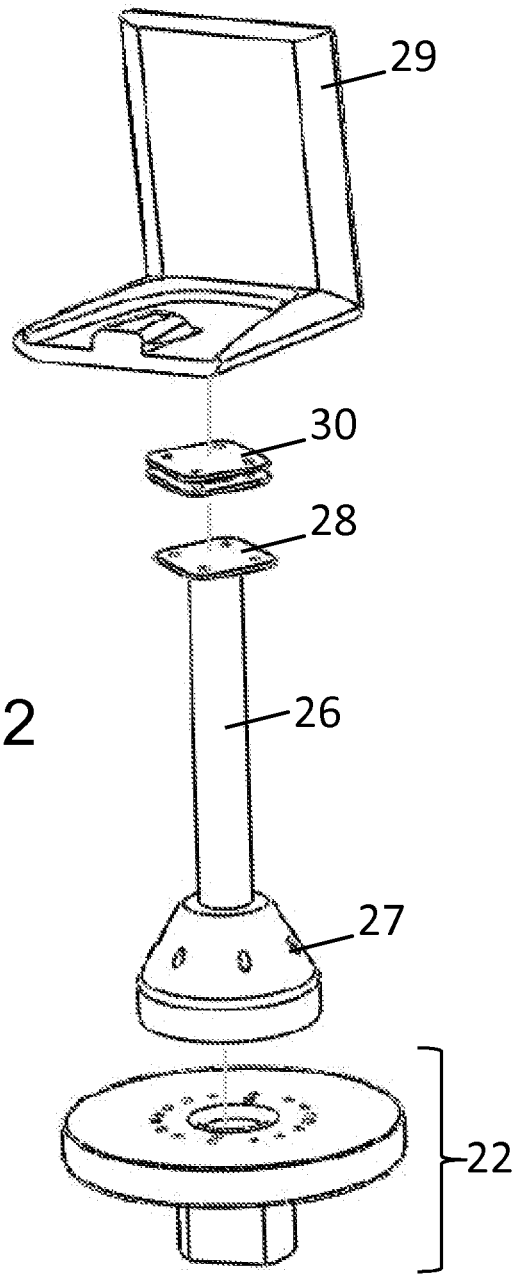
FIG. 22 is an exploded view of the pedestal mount assembly of FIG. 19 with a seat pedestal pole.
Figure 23:
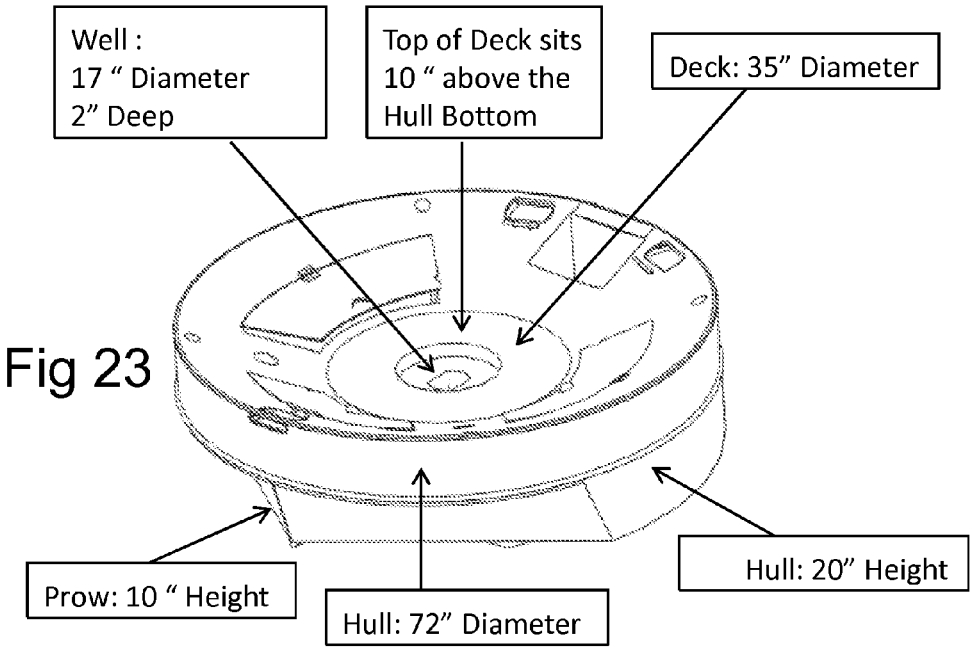
FIGS. 23 through 26 provide details for an exemplar of the preferred invention embodiment.
Figure 24:
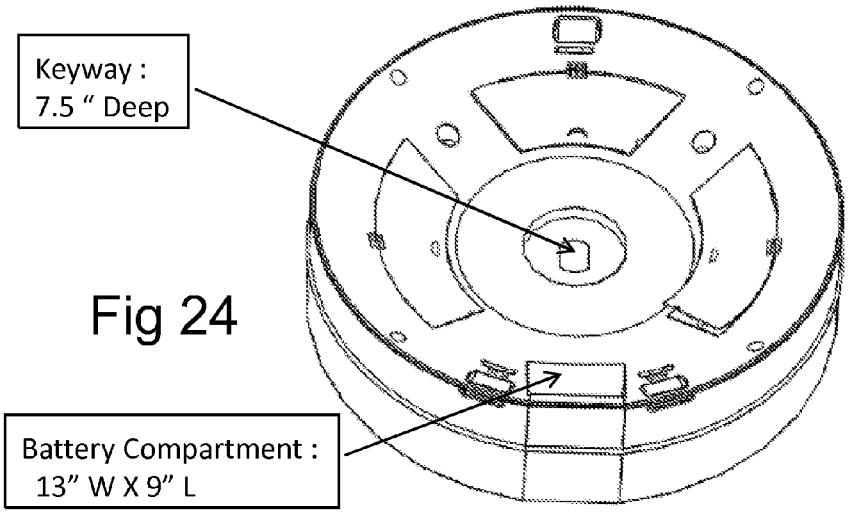
Figure 25:
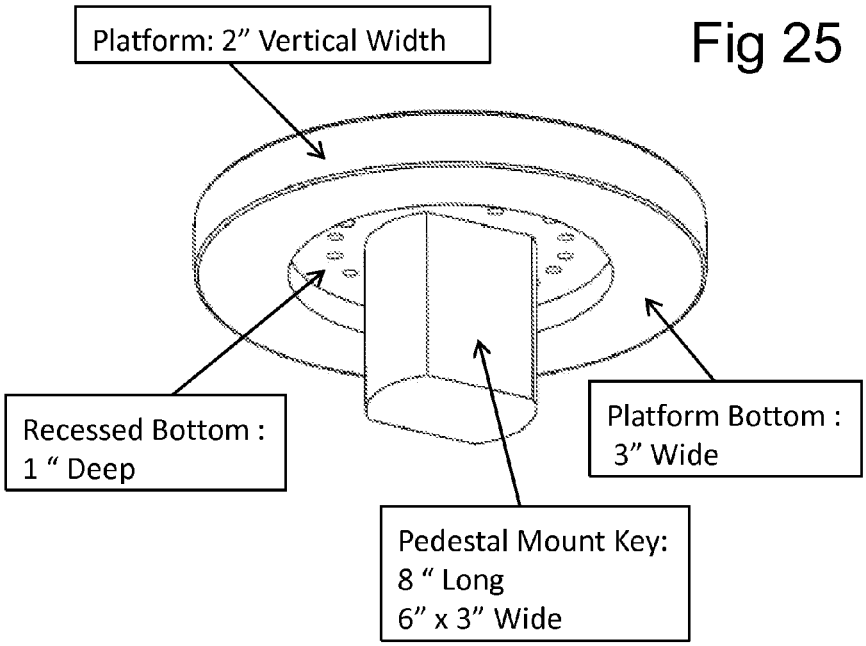
Figure 26:
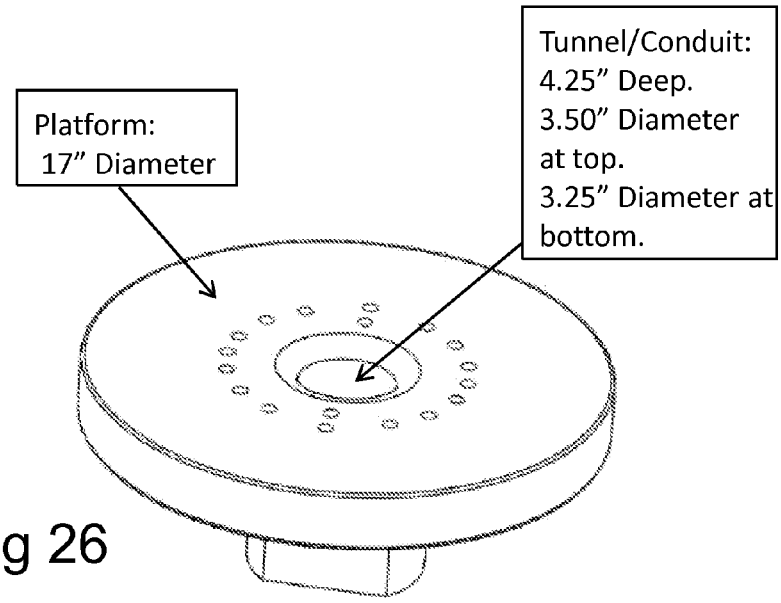
Figure 27:
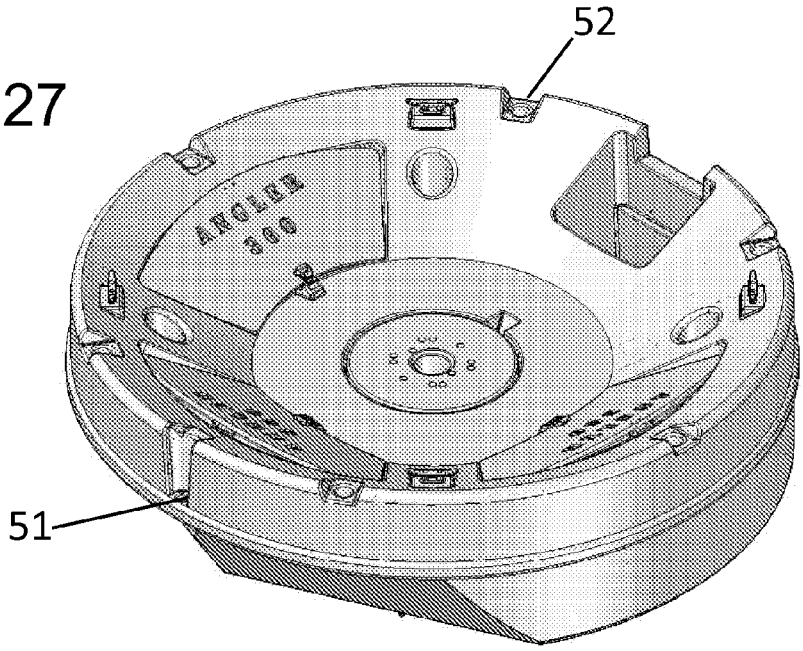
FIGS. 27 through 45 provide details of certain preferred variations for the preferred embodiments of the present invention, particularly as exemplified in FIGS. 23 through 26.
Figure 28:
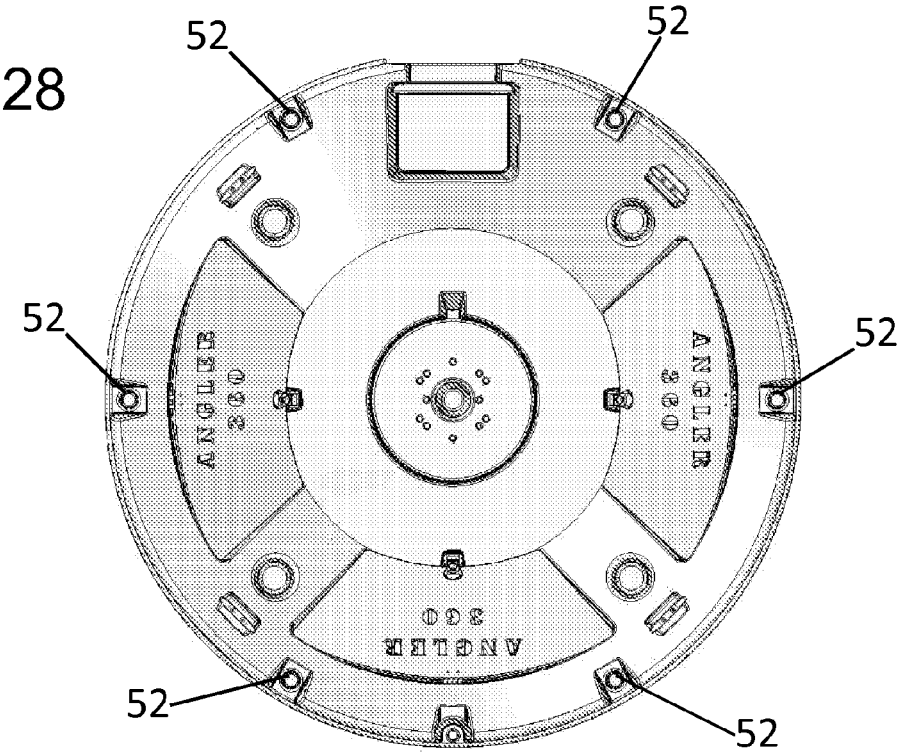
Figure 29:
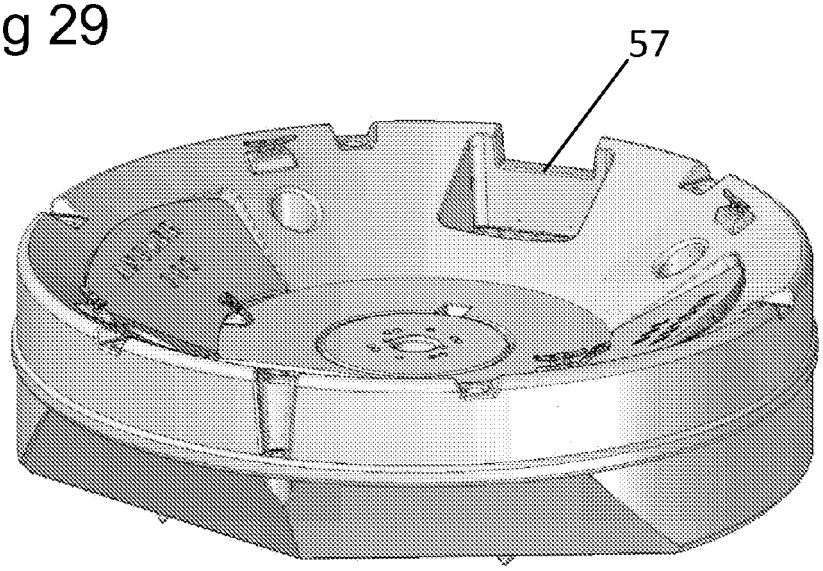
Figure 30:
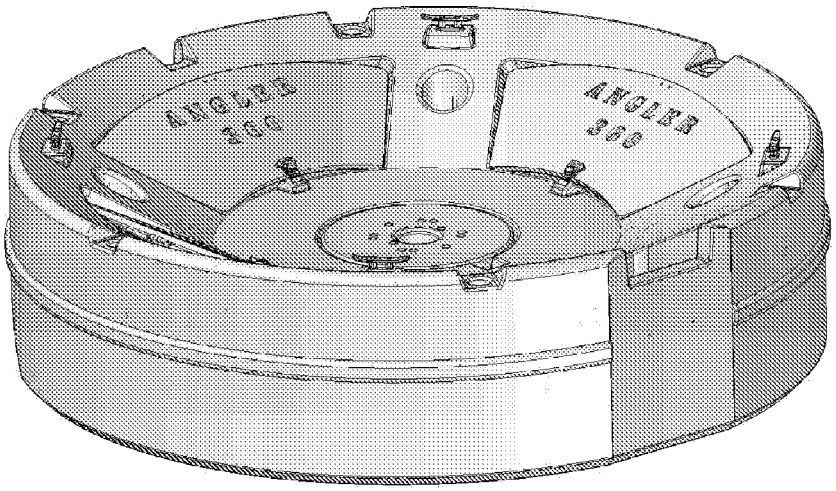

FIGS. 20 through 22 show the preferred pedestal mount (22). While it could be manufactured from individual parts, it is ideal for manufacture as a single unit. It is provided with a "key" (31) instead of the pedestal mount pole 24 of the FIG. 19 embodiment. In this case, the bottom of the central well (20) should be provided with a keyway (33) matching the shape of key 31.

In order to widen the use of the pedestal mount (22), it can advantageously be provided with a tunnel/conduit (34) through key (31) and is adapted to receive the terminal support end of the underside of a variety of commercially available pedestal seats. Similarly, pedestal mount 22 can be provided with mounting holes (not numbered) which will permit firmly fastening of mounts from commercially available pedestal seats to pedestal mount 22 of the present invention. In this way, the versatility of the present pedestal mount can be greatly expanded.

There are a number of non-essential, but very useful, accessories that are available for use with the present invention, and these are identified in FIGS. 12 through 14, 16 and 17. For general management of the boat, handles (40) and cleats (41) can be located, in the vicinity of the joinder of the inner and outer hull. Storage compartments (42) can be located in the space between the lower sections of the hulls with access through the inner hull; these are suitably provided with hinged covers, and are preferably watertight so as to utilize the compartment space as an addition to the overall flotation properties of the watercraft. An open battery compartment (43) is provided to ensure that any battery is confined to a particular location during movement of the boat; care should be taken to make certain that battery fluids cannot escape into the space between the inner and outer hull. Fishing rod holders (44) and cup holders (45) can be located as convenient.

Figure 31:
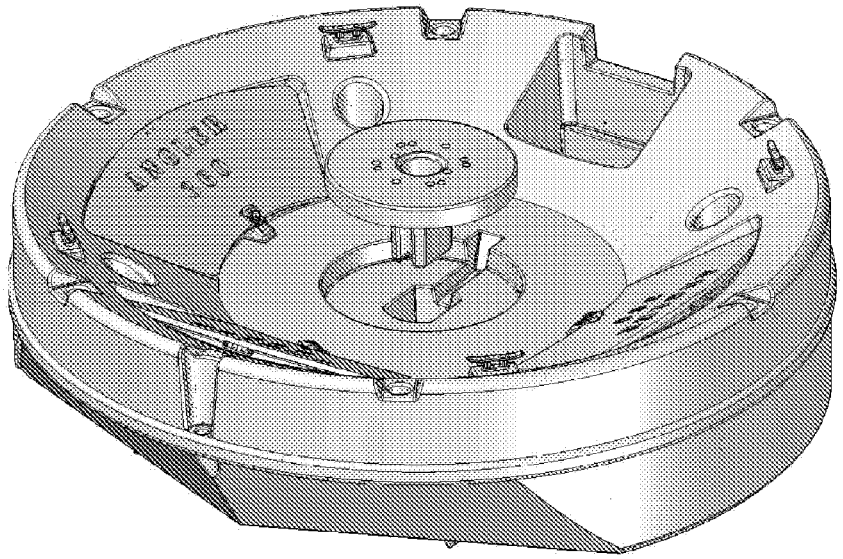
Figure 32:
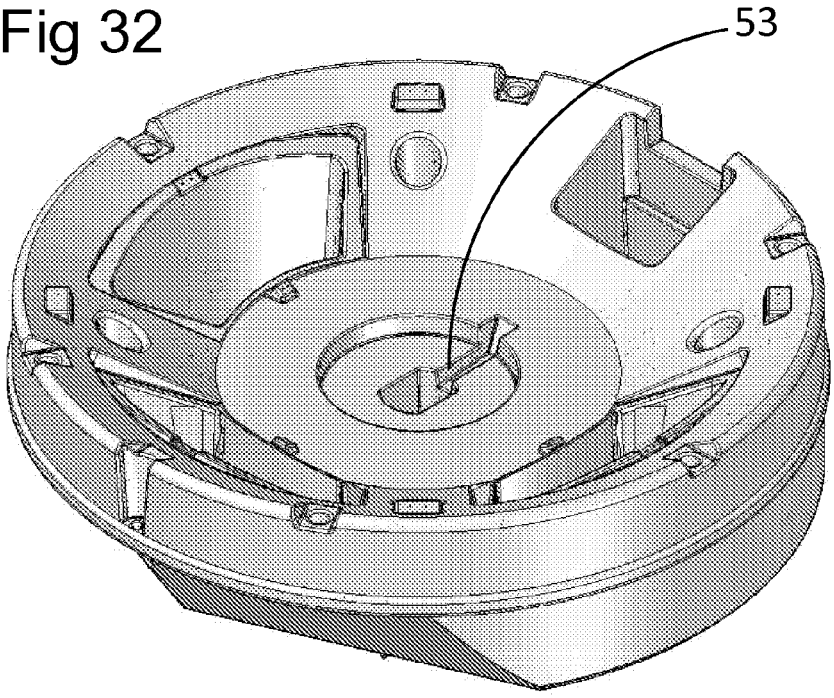
Figure 33:
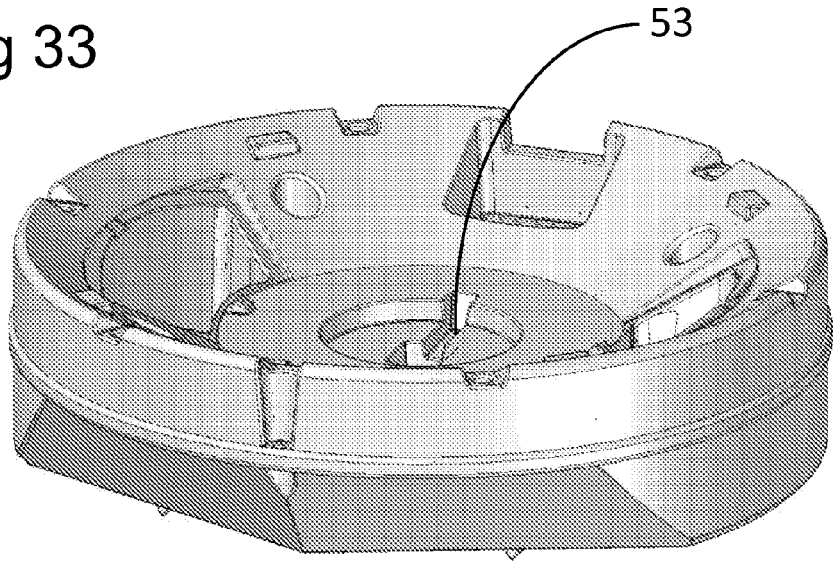
Figure 34:
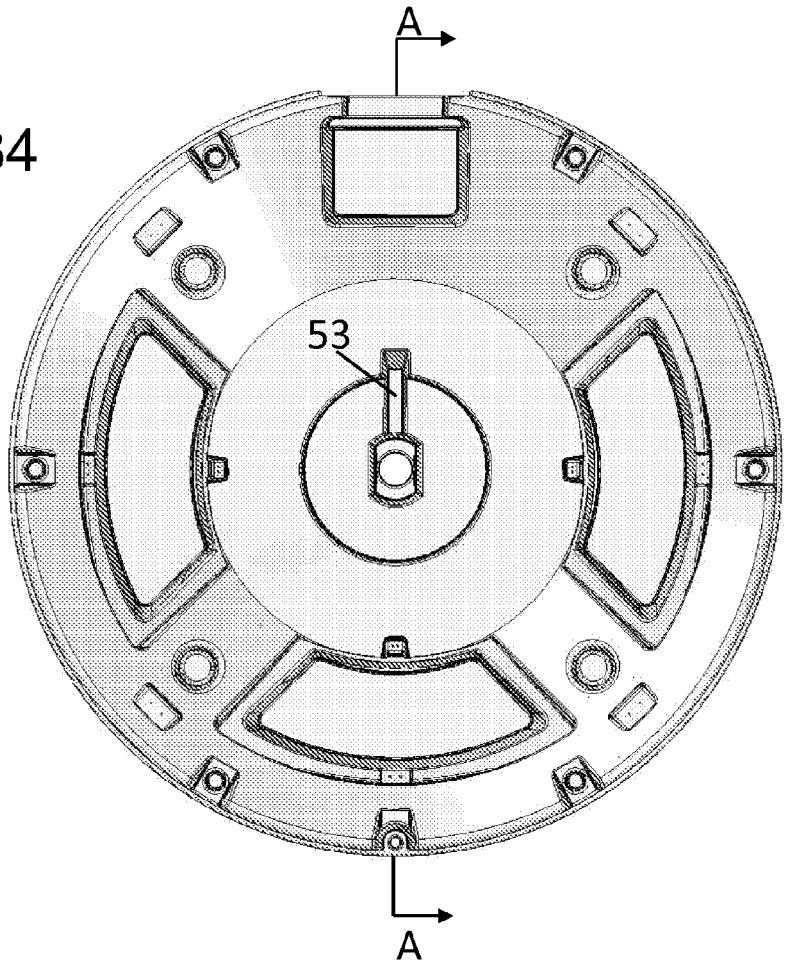
Figure 35:
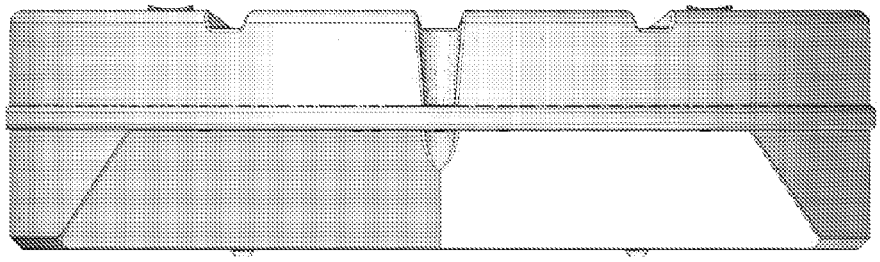
Figure 36:
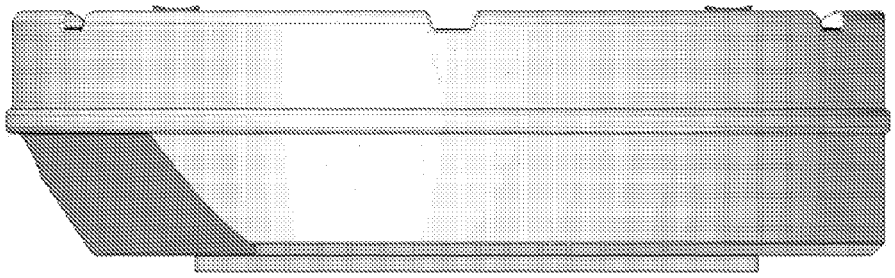
Figure 37:
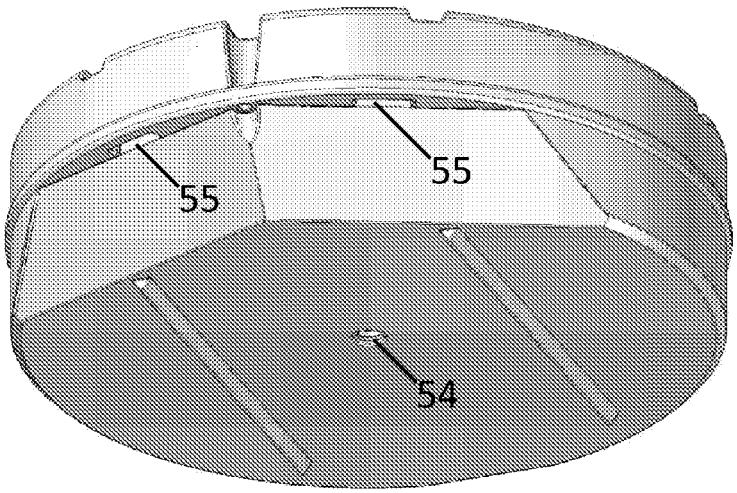
Figure 38:
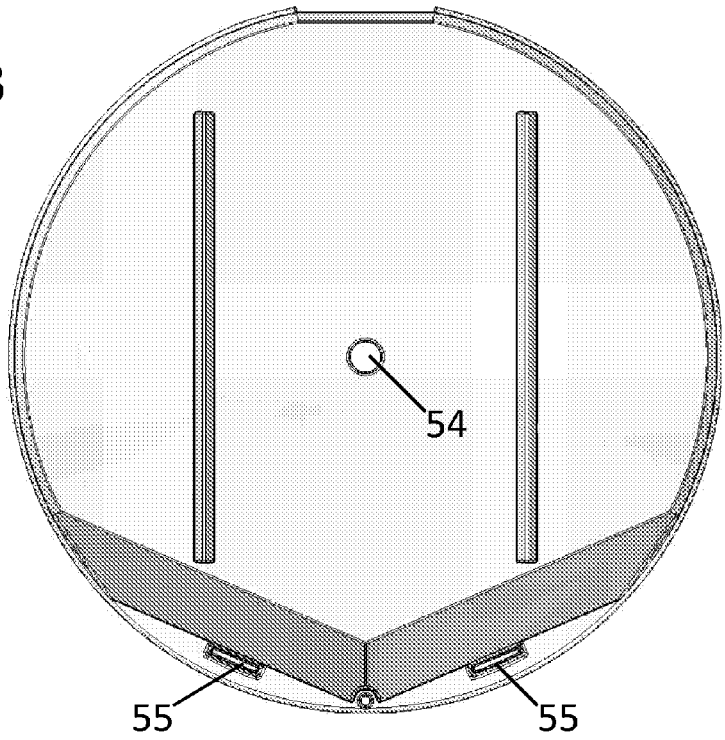
Figure 39:
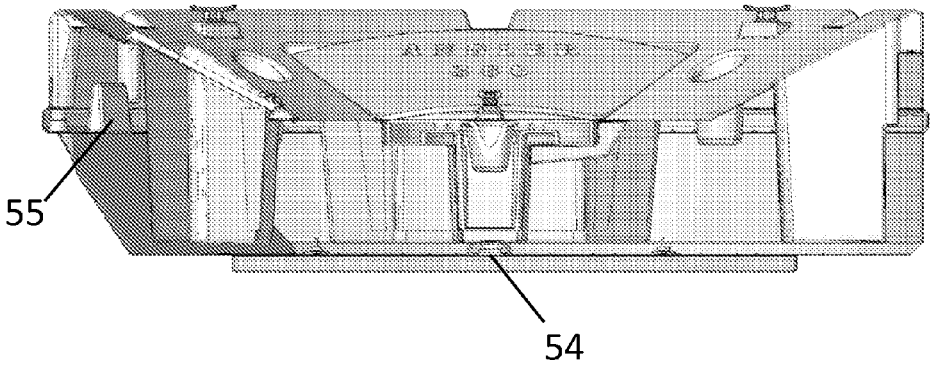
Figure 40:
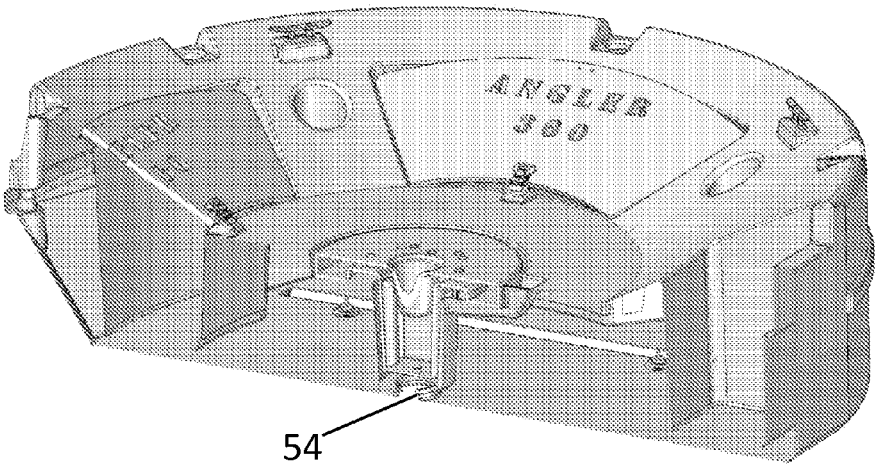
Figure 41:
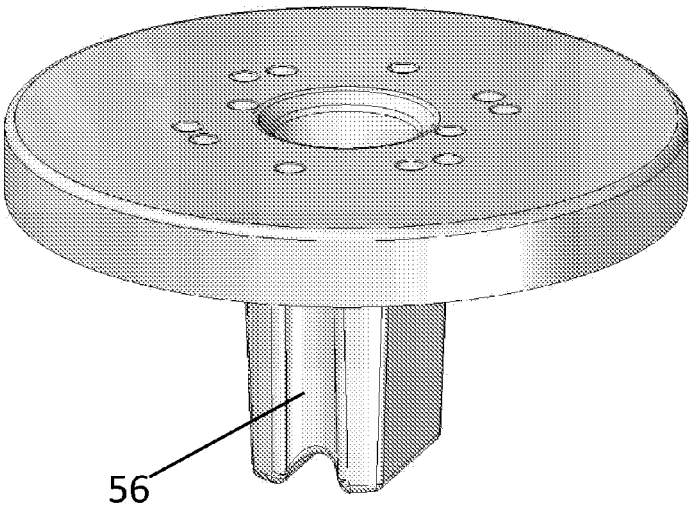
Figure 42:
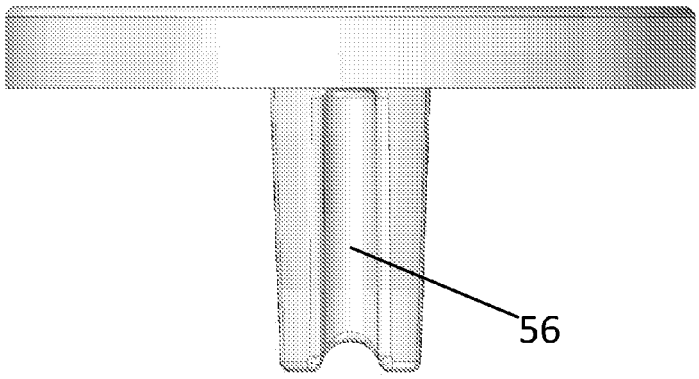
Figure 43:
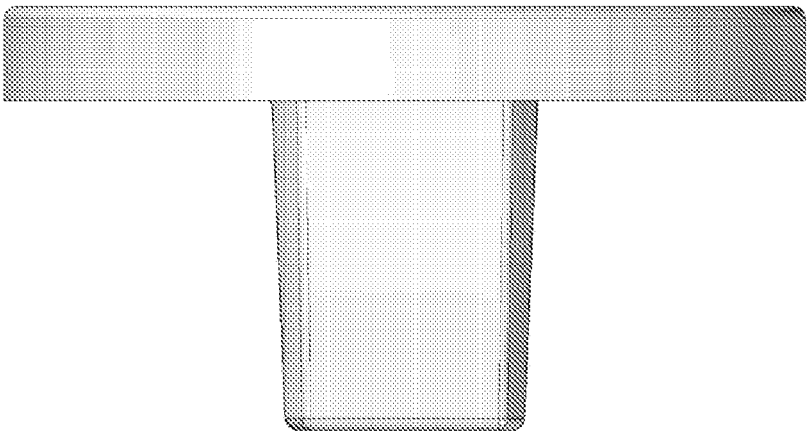
Figure 44:
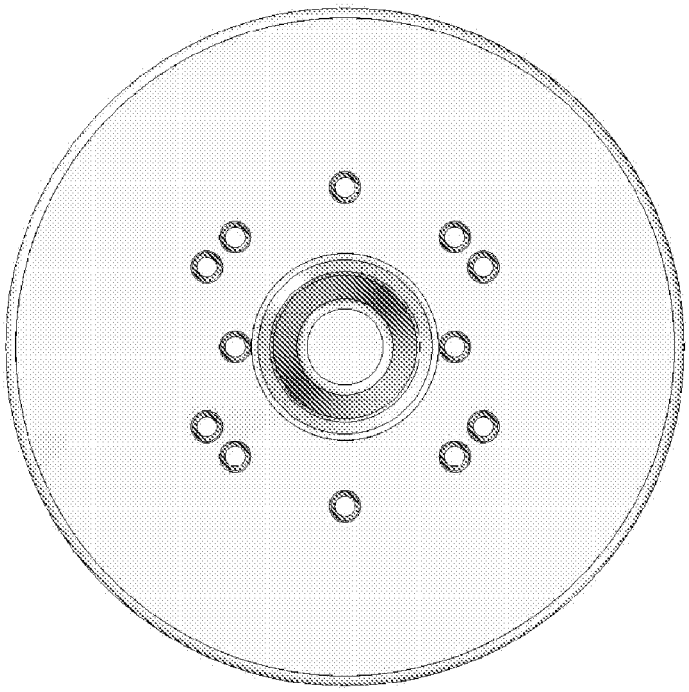
Figure 45:
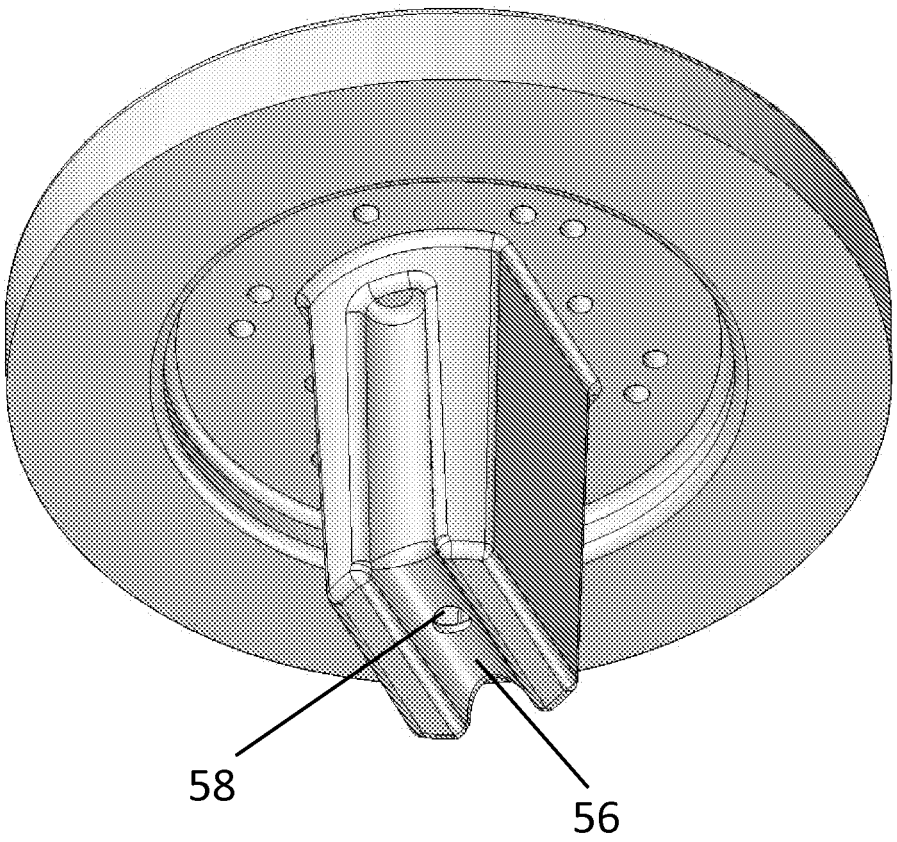

FIGS. 27 through 30 provide top, perspective views of the boat, with previously described accessories, including a pedestal mount, in place. FIG. 31 is similar except that the pedestal mount is shown as an exploded view. FIG. 32 is essentially the same as FIG. 27 except without the various accessories. FIG. 33 is essentially the same as FIG. 32 except that the perspective is changed to more clearly show the front of the boat. FIG. 34 is basically a top view of FIGS. 32 and 33. FIG. 35 provides a front view of the bow whereas FIG. 36 provides a side view of the port side of the hull. FIG. 37 provides a perspective view of the bottom of the hull whereas FIG. 38 provides a full bottom view of the hull. FIG. 39 is a bow-to-stern cross-section along the section line A-A of the boat shown in FIG. 34. FIG. 40 is similar to FIG. 39 with a slight downward tilt.

In these views of the preferred embodiment, eyelet (51) is a small diameter holes, e.g., ½ inch, running through the front middle portion of the bow, and running behind any rollbar/bumpers down through the top of the prow. Among other things, such eyelets are useful for tying on ropes such as for tow ropes.

The gunwales of the hull are provided with indentations (52) to provide places where a strap or rope can rest without sliding along the gunwales. Typically, these will useful with ropes, tie-down straps, anchor lines, or the like. Additionally, they can be adapted to serve as fishing rod holders so that the operator of the watercraft can perform non-fishing functions with free hands.

Deck channel (53) is a dual purpose drainage canal that runs from the top of the deck and down through the central well (20) (see, for example, FIG. 5), and allows water on the deck to drain into the keyway (33) and exit the boat through the center hole (54). This hole running through the center of the boat also has the important purpose of providing a means for securing of the boat with ropes, straps, chains, or the like to a vehicle or for outside storage.

Bow handles (55), in this embodiment, are handles located on the underneath of the top portion of the prow. They are hidden from view but allow the user to easily carry or pull the boat.

Key channel (56) is a channel located on on the sides of the pedestal mount key (31) that allows water to drain from the central well (20) though the center hole (58). It's primary purpose is so that water from the deck and central well can drain out of the hull through hole (54).

The middle portion of the transom (57) has been lowered from that shown in the earlier drawings herein. The primary purpose is so that the transom can accommodate electric motors with a smaller than usual shaft. Its secondary purpose is to act as a rope guide for a strap that can feed through the rope guide in the center of the bow where the eyelet is.

Doors (59) in this embodiment are flat instead of arculately contoured to the shape of the inner hull. These are a matter of manufacturing selection to reduce cost, but nevertheless can be designed to serve the same general function as the contoured doors illustrated earlier herein. In either case, it is advantageous for the doors to seat solidly against their individual compartments to be water tight not only to protect the compartment contents but to insure their use when empty as a contribution to the overall buoyancy system.

What I claim is:

1. A personal watercraft comprising:

a) a generally vertical outer hull;

b) a bottom member affixed to the lower edge of said outer hull and closing the watercraft from the encroachment of surrounding water into the vessel;

c) a generally concave inner hull rigidly attached at its upper edge to the upper edge of said outer hull and extending downwardly toward said bottom; and d) a generally horizontal deck fixedly attached at its edges to the lower edge of said inner hull to form an enclosed space with said outer hull, inner hull, and bottom member;

said deck having a size sufficient for the support of at least one person in a standing or reclining position and of sufficient strength and support to avoid undue bending from the weight of the user; and the interrelationship of said vertical outer hull, said convex inner hull, said bottom member, and said outer hull defining a contained space between the outer hull and the inner hull producing a floatation and buoyancy effect that urges an occupant away from said hulls toward the deck and center of the watercraft.

2. A personal watercraft in accordance with claim 1 wherein said outer hull is generally circular in horizontal cross-section.

3. A personal watercraft in accordance with claim 2 wherein the bottom of said watercraft is essentially flat.

4. A personal watercraft in accordance with claim 2 wherein the bottom of said watercraft has a displacement hull shape.

5. A personal watercraft in accordance with claim 3 in which a lower portion of the outer hull and a portion of the bottom are jointly modified to form a prow.

6. A personal watercraft in accordance with claims 4 in which a lower portion of the outer hull and a portion of the bottom are jointly modified to form a prow.

7. A detachable pedestal mounting system a for the deck of a watercraft comprising in combination: a $1^{st}$ part consisting of a pedestal mount and a $2^{nd}$ part pedestal mount receiver, said pedestal mount comprising a pedestal platform having a surface adapted for the fastening of pedestal seats thereto and a keying member extending downward from the center of the underside thereof, said pedestal mount receiver adapted to be fitted into the floor of a watercraft and attached thereto, and having a keyway in the center thereof matched to the keying member of said pedestal mount.

8. A detachable pedestal mounting system in accordance with claim 7 having a conduit passing centrally through said pedestal platform and through said keying member for the discharge of any accumulated water during usage into and through the matching keyway, and said keyway provided with means for discharging water received during the course of usage with said keying member.

9. A detachable pedestal mounting system in accordance with claim 8 in which said keying member is provided with channels alongside thereof for the discharging of any water accumulated under the pedestal platform during the course of usage, and delivering such accumulated water into and through the water discharging means of said matching keyway.

* * * * *